United States Patent [19]

Hoge et al.

[11] Patent Number: 4,615,644

[45] Date of Patent: Oct. 7, 1986

[54] PRESTRESSED TUNNEL LINING

[75] Inventors: Renon M. Hoge, Gates Mills, Ohio; Albert A. Mathews, Federal Way, Wash.

[73] Assignee: Mole Constuction Company, Solon, Ohio

[21] Appl. No.: 821,284

[22] Filed: Jan. 22, 1986

[51] Int. Cl.[4] ..... E21D 11/02

[52] U.S. Cl. ..... 405/151; 405/146; 405/150; 249/11; 264/31

[58] Field of Search ..... 405/146, 150, 151; 264/31; 249/10, 11

[56] References Cited

U.S. PATENT DOCUMENTS

| | | | |
|---|---|---|---|
| 2,020,519 | 11/1935 | Sarosdy | 249/11 |
| 3,418,812 | 12/1968 | Khan et al. | 405/151 |
| 4,010,616 | 3/1977 | Lovat | 405/132 |
| 4,452,549 | 6/1984 | Hart | 405/150 |
| 4,464,084 | 8/1984 | Wozniak | 405/151 |

*Primary Examiner*—Cornelius J. Husar
*Assistant Examiner*—Kristina I. Hall
*Attorney, Agent, or Firm*—Pearne, Gordon, Sessions, McCoy, Granger & Tilberry

[57] ABSTRACT

The invention provides a tunnel lining and a method of constructing the tunnel lining by aligning prestressed resilient lining panels of uniform thickness, such as plywood sheets, where longitudinal edges of the panels abut to form a ring. The longitudinal edges of the panel correspond to, and impose thrust against a second longitudinal edge of an adjacent panel. The thrust causes bending of the panels to form an arc about the longitudinal axis of the panels and to cause internal stresses within the ring to counteract loads applied at the exterior of the panels. The ring can consist of multiple layers of panels.

12 Claims, 4 Drawing Figures

PRESTRESSED TUNNEL LINING

BACKGROUND OF THE INVENTION

This invention relates to tunnel support linings and a method of creating such tunnel linings using flat plywood sheets bent and installed so that the horizontal edges abut and are secured in place in a prestressed condition.

Underground tunnels and shafts, such as the type used for roadways and railways, sewer control tunnels, subways and similar structures, require a temporary or primary supporting lining when driven through almost any strata except fault-free hard rock. The lining is needed for retaining the strata in which the tunnel is formed and maintaining the integrity of the tunnel against crumbling until a finished concrete liner can be installed, usually after the excavated tunnel is completed.

The prior art for constructing such temporary tunnel linings includes the practice of using circular metal ribs which retain wooden boards in a relationship parallel to the axis of the tunnel, known as rib and lagging. Other examples of tunnel linings include preformed arcuate concrete lining segments which join to form a circle in the tunnel, such as shown in U.S. Pat. No. 4,397,583.

It is known in the art to construct a tunnel lining from either arcuate lining segments or a plurality of relatively narrow sheet metal panels formed together to conform to the side of the wall of the tunnel, such as shown in U.S. Pat. No. 4,464,084.

It is desirable that the tunnel lining requires a minimum of effort for construction within the tunnel and at low cost as to both material and labor.

It is also important to provide a lining which can be installed immediately after the tunnel has been cut directly behind the shield or tunnel boring machine. In some rock conditions, a tunnel may be self-supporting as long as the tunnel surface contains a sufficient amount of moisture, but when the rock dries out, the rock will crumble and the surface erode.

It is also an advantage to provide a method of lining which can be adapted to the conditions of the tunnel as it is excavated. Although test borings are taken of the rock before the tunnel is bored, it is never clear exactly what conditions will be on the exposed surface of the tunnel walls. Some sections of a tunnel may be harder or softer rock. Thus, some sections of the tunnel may have an irregular or uneven surface where hard inclusions have been removed during excavation.

SUMMARY OF THE INVENTION

The invention provides a tunnel support lining and a method of creating the tunnel lining using flat plywood sheets installed by bending or flexing the sheets and pressing them against the tunnel wall so that the longitudinal edges abut. The stress of the lining against the tunnel walls helps to maintain the tunnel. Three-ply sheets of plywood may be used with the grain of the first and third plies parallel to the axis of the tunnel and the grain of the intermediate plies perpendicular to the grain of the other layers. Two or more layers of plywood may be used with overlapping joints and the thickness of the plywood sheet may vary with the radius of curvature of the tunnel wall.

The hoop stress caused by the sheets bears against the walls of the tunnel to hold the tunnel walls as well as the lining panels in place. Since the sheets are elastic to some extent, it is not crucial that the tunnel walls have a constant curvature and the sheets will, to some extent, conform to the tunnel walls. This support lining is used as a primary liner until the final liner is applied to the tunnel, and the final liner can be applied while leaving the primary lining in place.

In constructing the tunnel lining after a section of the tunnel is dug, a first layer of sheets of plywood is forced into place against the tunnel wall and may be secured with nails, spikes, or other fasteners, and a second layer subsequently secured against the tunnel so that the seams which are parallel to the axis of the tunnel of one layer overlap a middle section of the first layer of plywood. Large spikes are applied through both layers near the bottom edge to hold the liner in place. If the bottom of the tunnel is subsequently concreted, this will assist in holding the free edges of the sheets in place.

DETAILED DESCRIPTION OF THE DRAWINGS

This invention relates to a tunnel lining and a method of constructing the tunnel lining using flat plywood sheets or panels of the sort which are commercially available. The panels are flexed or deflected within the elastic limit to a curvature conforming to the curvature of the tunnel wall in abutting contact and positioned so that the longitudinal edges abut. Each panel thus imposes a thrust along the longitudinal edge of the adjacent panel which maintains the prestresed condition and biases the panels against the curved wall of the tunnel. The hoop stress caused by the panels bears against the walls to hold the tunnel walls in place and, similarly, the tunnel walls bear against the plywood lining.

Figure 1:
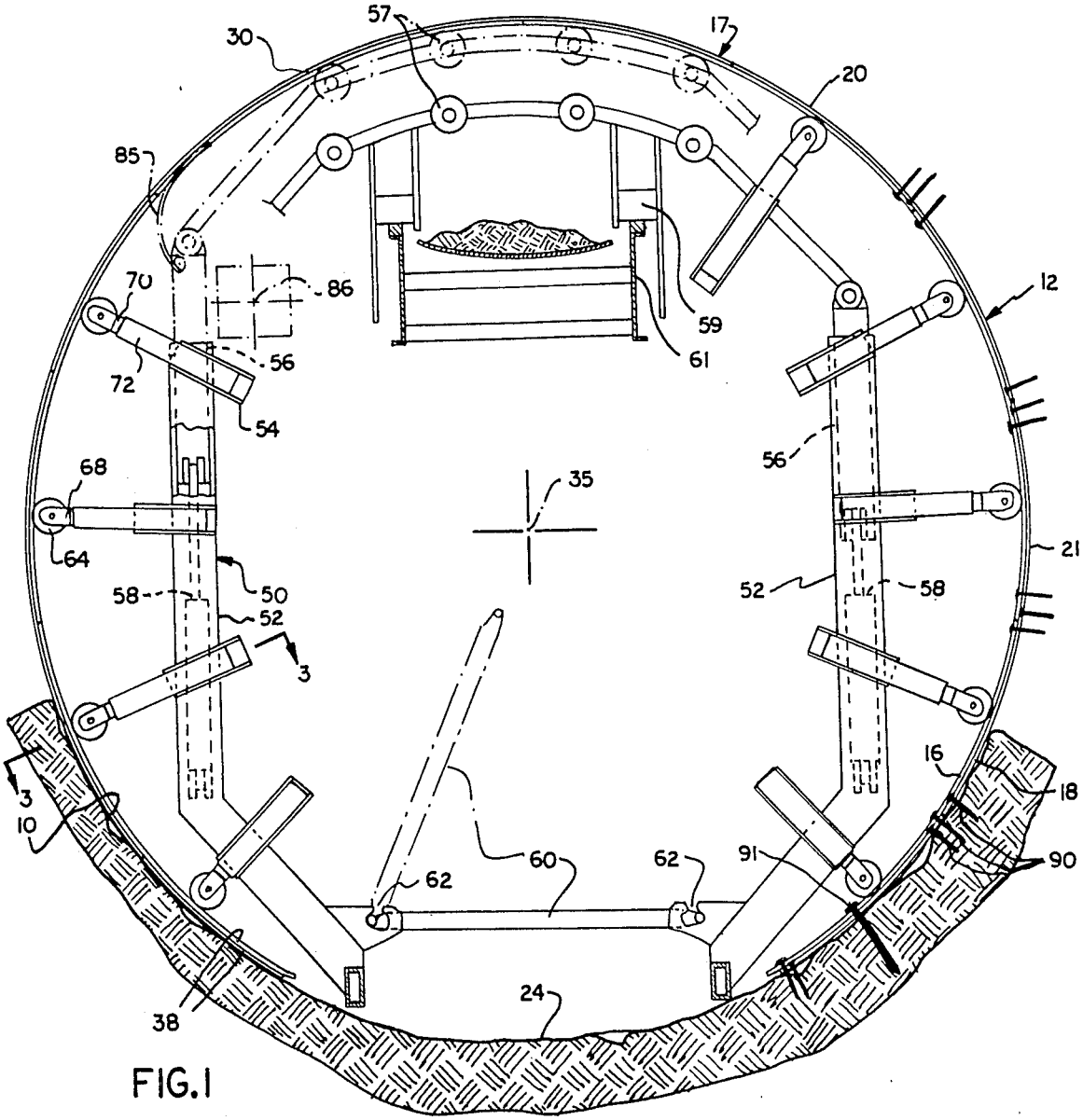
FIG. 1 is a cross-sectional view normal to the tunnel axis showing the lining in place and apparatus for installing the lining.
Figure 1A:
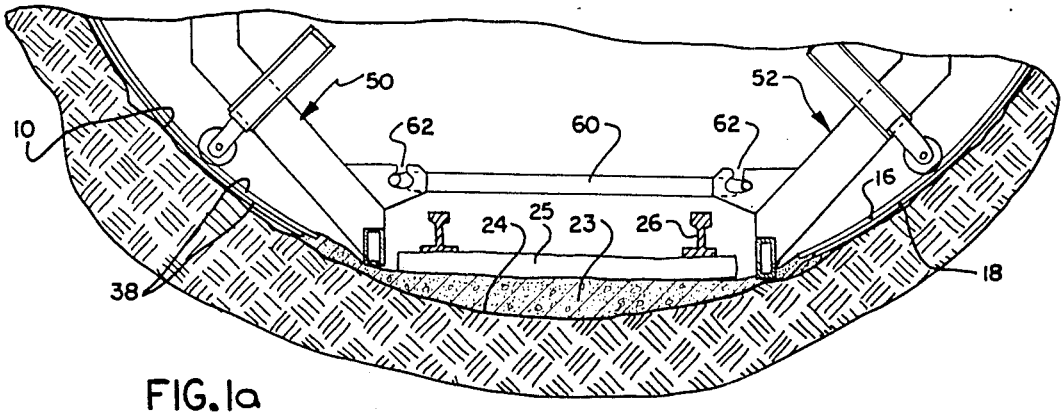
FIG. 1*a* is a fragmentary view similar to FIG. 1 showing the concrete bottom liner and track installation.

FIG. 1 shows a tunnel 10 having a tunnel lining 12 in accordance with the invention and an apparatus 50 for installation of the lining. The tunnel lining 12 includes a plurality of support rings 17 each formed with an interior layer 16 and an exterior layer 18, and may include a concrete base 23 in the tunnel floor 24, as shown in FIG. 1*a*. Rails 26 for tunneling equipment are set on ties 25 on the concrete base 23.

The interior layer 16 and the exterior layer 18 are each formed from flat, resilient panels 21 having a uniform thickness. The panels 21 are prestressed and biased against the wall surface 20 of the tunnel 10 by bending or flexing the panels to conform to the curvature of the tunnel wall. The panels 21 are aligned so that the longitudinal axis of each panel is parallel with the longitudinal axis 35 of the tunnel 10. Further, the longitudinal edges 30 of each panel 21 are aligned in abutting relationship to cooperate with the longitudinal edge 30 of an adjacent panel 21. A series of panels 21 are joined together to form a continuous partial ring 17 which covers about the upper 300 degrees of tunnel wall surface 20. A series of rings 17 are joined together laterally to form the tunnel lining 12.

Figure 2:
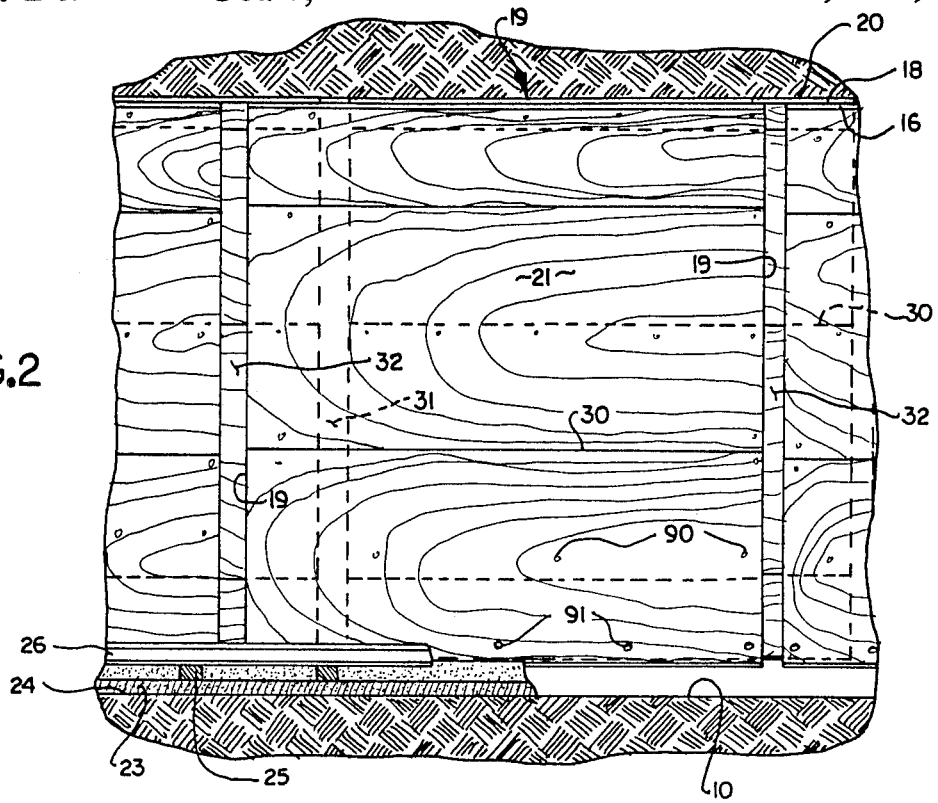
FIG. 2 is a side vertical cross-sectional view taken along the longitudinal axis with the lining installed.

As shown in FIG. 2, each of the panels 21 of a ring section layer has lateral or end edges 19 which are in axial alignment to define a circular edge lying in a plane perpendicular to the tunnel axis 35. The circular edge of adjacent ring sections do not abut but are spaced apart by a small axial gap. Furthermore, the inner layer 16 is shifted axially with respect to the outer layer 18 so that the axial gap 31 in the outer layer is covered by the inner layer 16 and the gap 32 in the inner layer exposes only the panels of the outer layer 18. The panels of the inner layer are shifted circumferentially from the panels of the outer layer by half a panel width, so that each abutting joint along the longitudinal edges 30 aligns with the middle of the adjacent panel in the other layer.

The presence of the gaps 31 and 32 ensures that each ring section layer will maintain proper abutting engagement along the longitudinal edge 30 to maintain the prestressed bending of all of the panels in the layer. If the gaps were not present so that the panels of adjacant sections abutted along the lateral or end edge 19, any misalignment by not having the longitudinal edges 30 exactly parallel to the tunnel axis 35 would tend to perpetuate and magnify on axially successive sections; yet by axially offsetting the gaps 31 and 32, full coverage of the tunnel wall is ensured.

In order to hold the panels of each ring in place, it is necessary that the lowermost panel on each side be securely fastened to the tunnel wall at a point adjacent the lower edge. This is done preferably by the use of fasteners such as spikes or pins 91 of sufficient length to prevent any movement of the adjacent panel which would unload the prestressing force which maintains the curvature of the panels forming the support ring. It is also possible to utilize the concrete base 23 to assist in holding the lowermost panels in place. Of course, it should be understood that the ring may also extend 360 degrees around the tunnel, but this would require cutting of the panels to fit in order that the resilient panels form a ring of constant circumference.

The resilient panels 21 are plywood panels which are initially flat, but which are deflected to assume the curvature of the tunnel wall surface 20. Other flexible material, such as sheet metal or flexible plastic sheets, could be used in place of plywood.

The panels are rectangular and are standard size plywood sheets, generally four feet by eight feet. The thickness and the number of plies of the panel will vary according to the radius of the bending and to the load of the soil. For example, for a tunnel having an excavated diameter of 112 inches, the required bending radius is 56 inches. The minimum bending radius across grain for $\frac{1}{2}$ inch plywood panels is six feet, while the minimum bending radius across grain for $\frac{3}{8}$ inch panels is three feet. Therefore, the maximum thickness panel for this bending radius is $\frac{3}{8}$-inch. Under such circumstances, it is appropriate to use two layers of $\frac{3}{8}$-inch three-ply APA Structural I rated Sheathing Exp 1 plywood with the face grain running parallel to the longitudinal axis of the tunnel. For a tunnel with a large diameter, panels havng greater plies may be used, or the plywood may be oriented with the face grain perpendicular to the axis of the tunnel. It is also understood that a single layer of plywood sheets may be used if the condition of the tunnel wall does not require the structural strength of a double layer.

Where it is necessary, additional support can be provided by steel channel rings, or rib and lagging may be interspersed with the plywood rings. The steel channel rings are installed against the plywood by expanding with hydraulic jacks or by other acceptable means. The rings can be added at any time after the plywood is installed. For example, the rings may be installed as reinforcement if the plywood tunnel linings indicate distress by internal deformations.

In addition, if the tunnel wall surface is too uneven, it would be possible to use a plastic or metal joint strip, such as an H-strip, which serves to align the longitudinal edges of the panel.

Although it is possible to install the panels entirely by hand, a panel flexing and installing device 50 may be used for the installation of the plywood panels, as is illustrated in FIG. 1. The panel flexing device 50 includes a generally circular frame 52 having pivotally mounted biasing arms 54 and fixed rollers 57 at the top. The frame 52 has telescoping vertical sides 56 which can be elongated by activating a hydraulic or air cylinder 58. When the vertical sides 56 have been lengthened, the rollers 57 bear against the ceiling of the tunnel. Wheels 59 support the panel flexing device 50 which is transported on a longitudinal track 61 when the vertical sides 56 are in their fully contracted position. This allows the bottom of the frame 52 to clear the bottom of the tunnel as the device is advanced to the next tunnel section to be lined. The track 61 also serves to support the conveyor which carries dirt from the tunnel boring machine as the tunnel is dug. A removable cross bar 60 is latched to hooks 62 on either side of the frame 52 to brace the frame 52.

The biasing arms 54 are positioned so that they will form a contact with the tunnel wall 20 when they are in an extended position. The biasing arms 54 are positioned so that each resilient panel 21 will be biased against the tunnel wall by one or more biasing arms 54 or by the rollers 57.

Figure 3:
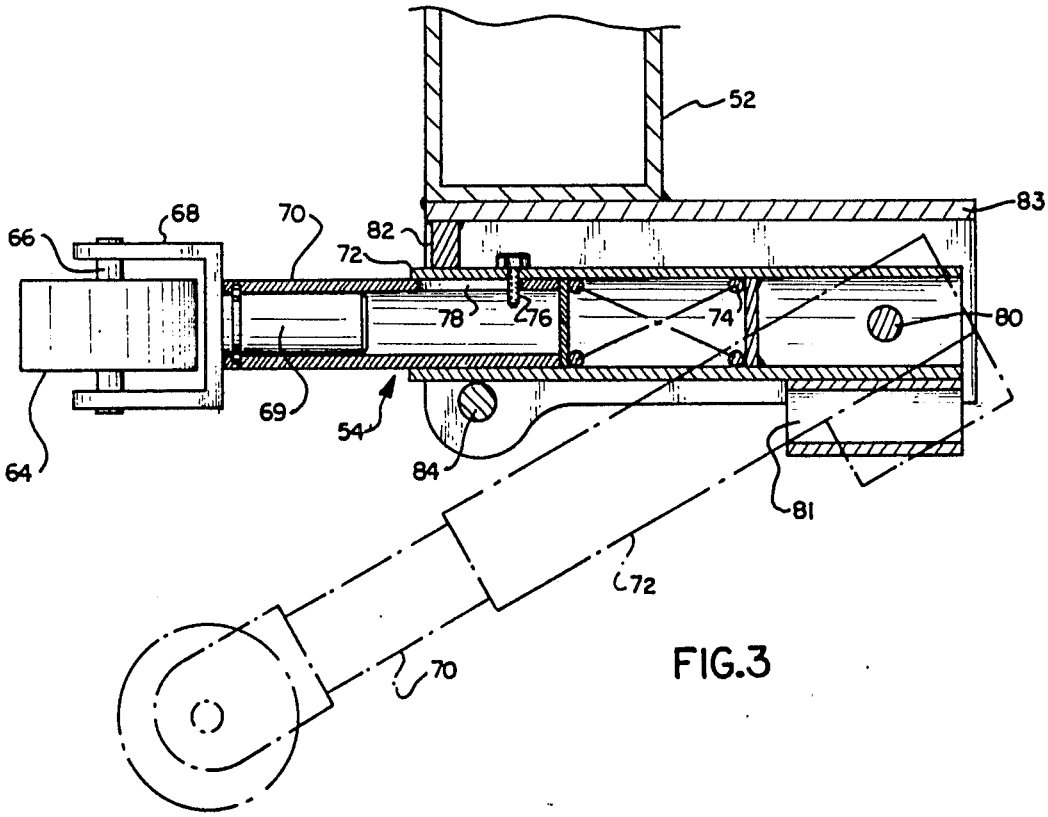
FIG. 3 is a detailed view of the lining application roller taken along line 3—3 of FIG. 1.

As shown in FIG. 3, each of the biasing arms 54 terminates in a wheel or roller 64 which is journaled on an axle 66 mounted in a yoke 68. The yoke 68 extends from a shank 69 pivotably received in the inner sleeve 70 of the biasing arm 54. The inner sleeve 70 is supported in an outer sleeve 72 and is biased axially outward by a spring 74. A screw or pin 76 extends through a slot 78 in the inner sleeve 70 to hold the inner sleeve 70 in the outer sleeve 72.

The biasing arms 54 are mounted to the frame 52 at a pivot 80. The biasing arms 54 are pivoted into tight contact with the wall surface 20 of the tunnel by inserting a metal bar in the opening 81 and forcing the biasing arm 54 to pivot at pivot 80 so that the wheel 64 comes into contact with a resilient panel 21 and biases the panel against the tunnel wall surface 20. The biasing arm will pivot to a transverse position where it will contact a mechanical stop 82 in the bracket 83. A rod 84 is lowered to lock the arm 54 in position.

The yoke 68 is pivotally mounted by shank 60 so that the axle 66 can be positioned parallel to pivot 80 before installing a plywood sheet. As the arm is pivoted to the transverse position to flex the sheet to conform with the tunnel wall curvature, the wheel 64 will roll freely across the plywood surface. After the arms holding a sheet are locked in the transverse position, the yokes 68 are rotated 90 degress so that the axles 66 are parallel to the tunnel axis. This allows the sheet to be moved circumferentially until the longitudinal edge 30 abuts the adjacent panel.

Often a laser is used as a sight to ensure that the tunnel boring machine maintains the correct path. If this is the case, one of the biasing arms may be replaced with a spring 85 which biases the panel 21 against the tunnel wall 20 so that the biasing arm does not interfere with the path of the laser 86.

The tunnel lining can be installed as follows. At least a first portion of the tunnel is excavated with a tunnel boring machine to provide a relatively uniform, circular surface against which the plywood panels bear. After being cut by the tunnel boring machine, the rock or ground must be able to stand up long enough to complete the installation of at least one layer of plywood. If the standup time is too short to permit use of eight-foot long plywood panels, shorter panels may be used. If the ground does not stand long enough to move the thrust ring of the tunnel boring machine ahead and erect a plywood ring, another expedient must be used. Either the thrust ring may be moved ahead in very short increments and very short rings of plywood or other material may be used or—and this may occur only in certain formations encountered in the tunnel—more conventional tunnel lining methods must be employed.

After a section of tunnel is cut, a first resilient panel 21 is inserted in place between the tunnel wall surface 20 and the rollers 57. After the initial panel has been biased against the tunnel wall surface 20 with the longitudinal edges 30 of the resilient panel parallel to the longitudinal axis 35 of the tunnel, the panel 21 may be nailed into position with spikes or nails 90. Normally, it is necessary to use a line of spikes or nails 90 only along the longitudinal centerline of each sheet to maintain the curvature of each sheet by holding the center portion against the tunnel wall. These nails 90 need not be as long as the spikes 91 at the bottom of the ring, since they need hold the sheet only until the ring is complete and the spikes 91 set in place. After the panel is nailed in place, a second panel 21 is inserted between the panel flexing device 50 and the tunnel wall surface 20, and flexed against the wall 20 using one of the biasing arms 54 or the spring 85. The panel is aligned with the longitudinal edges 30 parallel to the longitudinal axis 35 of the tunnel 10, and the longitudinal edge 30 abutting the longitudinal edge of the first panel 21. The biasing arms 54 are used to flex the panel 21 by pivoting the biasing arms 54 at the pivot point 80 and flexing the panel into position against the tunnel wall surface 20. This process is repeated until a ring is formed which is part of the continuous exterior layer 18.

After all of the panels in the exterior layer 18 of the support ring 17 have been fastened in place with the nails 90, the biasing arms 54 are withdrawn in preparation for the installation of the interior layer 16. The panels in this layer are installed in position offset from the panels in the exterior layer 18, as described above. When these panels are all in place and held by their set of nails 90, the row of spikes 91 are put in place to serve as the final or permanent anchor for the support ring. Since the spikes 91 firmly hold the lowermost panels in both layers, the prestresed condition of all panels will be maintained even if the nails 90 were to loosen.

Plywood sections are added until the length of the tunnel has been covered, or, in the event that it is necessary, the sections may be combined with other conventional methods of tunnel lining, such as ribs and lagging, in sections of the tunnel where it is necessary.

The tunnel may later be completed by installing the final liner with the primary tunnel lining in place.

Although the preferred embodiment of this invention has been shown and described, it should be understood that various modifications and rearrangements of the parts may be resorted to without departing from the scope of the invention as disclosed and claimed herein.

What is claimed is:

1. A tunnel lining for a tunnel having a longitudinal axis and having a curved tunnel wall surface, comprising:

a plurality of resilient tunnel lining panels cooperating to form a ring, each of the tunnel lining panels having a longitudinal axis, longitudinal and lateral edges, and exterior and interior surfaces;

the longitudinal axis of the panel being parallel to the longitudinal axis of the tunnel;

at least a first longitudinal edge of each panel corresponding to and imposing thrust against a longitudinal edge of an adjacent panel, the thrust causing elastic bending of the panel to form an arc; and means to restrain the panels from radial movement, the exterior surfaces of the tunnel lining panels forming a continuous exterior surface of the layer which bears tightly against the tunnel wall surface, the thrust causing internal stresses within the layer to counteract load applied at the exterior surface by the tunnel wall surface.

2. A tunnel lining as set forth in claim 1, wherein the tunnel lining panels are of uniform thickness and are rectangular, the longitudinal edges of the panels are generally parallel to the longitudinal axis of the tunnel and the lateral edges are generally perpendicular to the longitudinal axis of the tunnel, and the thrust causes bending of the panel to form an arc about the longitudinal axis of the panel.

3. A tunnel lining as set forth in claim 2, further comprising a plurality of pins which anchor the tunnel lining panels to the tunnel wall surface.

4. A tunnel lining as set forth in claim 2, wherein the tunnel lining panels are composed of wood.

5. A tunnel lining as set forth in claim 4, wherein the tunnel lining panels are composed of plywood having at least three plies.

6. A tunnel lining as set forth in claim 5, wherein the tunnel lining comprises an exterior layer of tunnel lining panels and an interior layer of tunnel lining panels, the exterior layer and interior layer being concentric and the interior surface of the exterior layer cooperating with the exterior surface of the interior layer, and the longitudinal edges of the interior layer panels being parallel to but spaced radially apart from the longitudinal edges of the exterior layer panels.

7. A tunnel lining as set forth in claim 1, including a concrete base in the floor of the tunnel.

8. A tunnel lining for a tunnel having a longitudinal axis and having a tunnel wall surface and floor, comprising:

a plurality of resilient tunnel lining panels which cooperate to form an exterior layer and an interior layer, the tunnel linng panels each having a longitudinal axis, two longitudinal edges, two parallel lateral edges, and exterior and interior surfaces, the longitudinal axes of the panels being parallel to the longitudinal axis of the tunnel, the lateral edges of the panels being perpendicular to the longitudinal axis of the tunnel, the tunnel lining panels being composed of plywood;

at least a first longitudinal edge of each panel corresponding to and imposing thrust against a second longitudinal edge of an adjacent panel, the thrust causing bending of the panel to form an arc about the longitudinal axis of the panel and means to restrain the panels from radial movement;

the exterior surfaces of the tunnel lining panels forming a continuous exterior and interior surface of each layer;

the exterior layer and the interior layer being concentric, the exterior surface of the exterior layer bearing tightly against the tunnel wall surface, the interior surface of the exterior layer cooperating with the exterior surface of the interior layer;

the longitudinal edges of the interior layer panels being spaced radially apart from the longitudinal panels of the exterior layer panels; and the thrust causing internal stresses within the exterior and interior layer to counteract load applied at the exterior surface of the layers by the tunnel wall surface.

9. A method of constructing a tunnel having a longitudinal axis and a tunnel wall surface and a tunnel floor, comprising:

(a) boring at least a section of a tunnel with a tunnel boring machine;

(b) constructing a ring of resilient panels, each of the panels having a longitudinal axis, two longitudinal edges and two lateral edges, the ring being constructed by the steps of (i) aligning a first resilient panel so that the longitudinal axis of the first resilient panel is generally parallel to the longitudinal axis of the tunnel;

(ii) imposing a first force on the first resilient panel to form an arc about the longitudinal axis and to form a first biasing contact with the tunnel wall surface;

(iii) maintaining the first resilient panel in the first biasing contact while aligning a second similar resilient panel so that the longitudinal axis of the second resilient panel is generally parallel to the longitudinal axis of the tunnel and so that a longitudinal edge of the second resilient panel will cooperate with a longitudinal edge of the first resilient panel and imposing a second force on the second resilient panel to form an arc about the longitudinal axis and to form a second biasing contact with the tunnel wall surface;

and repeating the steps of aligning and bending resilient panels and maintaining panels which are aligned and bent to form a biasing contact until the ring of resilient panels is constructed; and (c) securing the panel against radial movement.

10. A method of constructing a tunnel as set forth in claim 9, wherein the securing step comprises inserting a plurality of pins through the resilient panels to the tunnel wall surface.

11. A method of constructing a tunnel as set forth in claim 10, wherein said securing step additionally comprises providing a concrete base in the tunnel floor.

12. A method of constructing a tunnel as set forth in claim 9, wherein an exterior layer and a concentric interior layer of resilient panels are formed, the longitudinal edges of the interior panels being parallel to but spaced apart from the longitudinal edges of the exterior panels.

* * * * *